US006027388A

United States Patent [19]

Jones et al.

[11] Patent Number: 6,027,388

[45] Date of Patent: Feb. 22, 2000

[54] LITHOGRAPHIC STRUCTURE AND METHOD FOR MAKING FIELD EMITTERS

[75] Inventors: Gary W. Jones; Susan K. Jones, both of Lagrangeville; Amalkumar P. Ghosh, Poughkeepsie, all of N.Y.

[73] Assignee: Fed Corporation, Hopewell Junction, N.Y.

[21] Appl. No.: 08/906,311

[22] Filed: Aug. 5, 1997

[51] Int. Cl.[7] ..... H01J 9/02

[52] U.S. Cl. ..... 445/24; 445/50

[58] Field of Search ..... 445/24, 50

[56] References Cited

U.S. PATENT DOCUMENTS

| | | | |
|---|---|---|---|
| 5,219,788 | 6/1993 | Abernathey et al. | 438/636 |
| 5,328,560 | 7/1994 | Hanawa et al. . | |
| 5,378,182 | 1/1995 | Liu | 445/24 |
| 5,528,099 | 6/1996 | Xie et al. . | |
| 5,547,787 | 8/1996 | Ito et al. . | |
| 5,576,359 | 11/1996 | Urano et al. . | |
| 5,688,158 | 11/1997 | Jones et al. | 445/50 |
| 5,771,098 | 6/1998 | Ghosh et al. | 356/363 |

*Primary Examiner*—Kenneth J. Ramsey

*Attorney, Agent, or Firm*—Collier, Shannon, Rill & Scott, PLLC; David R. Yohannan

[57] ABSTRACT

A mask structure may be formed on a field emitter substrate for use in forming emitter wells on and in the substrate. The mask structure may be formed from a multilayered structure on the surface of the substrate using a laser lithography process. From the substrate up, the multilayered structure may include an antireflective coating, a photoresistive layer, an optional etch resistant layer between the antireflective coating and the photoresistive layer, and an optional second antireflective coating between the optional etch resistant layer and the photoresistive layer. The pattern of the mask structure may be transferred to the multilayer structure by exposing the photoresistive layer to laser light. The antireflective coatings may reduce the amount of stray laser light that reflects off the substrate and onto the back of the photoresistive layer. Development of the photoresistive layer following exposure to laser light may be monitored and selectively arrested to form a mask structure with a selective pitch. The antireflective coating may be etched optionally so that it is undercut beneath the overlying etch resistant layer or photoresistive layer to aid in the formation of emitters using a veil field emitter process or an etched gate process.

35 Claims, 5 Drawing Sheets

LITHOGRAPHIC STRUCTURE AND METHOD FOR MAKING FIELD EMITTERS

FIELD OF THE INVENTION

The present invention relates to lithographic mask structures and methods used to make microminiature field emitters. More specifically, the present invention relates to laser interference lithography structures and methods.

BACKGROUND OF THE INVENTION

Microminiature field emitters are well known in the microelectronics art. These microminiature field emitters are finding widespread use as electron sources in microelectronic devices. For example, field emitters may be used as electron guns in flat panel displays for use in aviation, automobiles, workstations, laptops, head wearable displays, head-up displays, outdoor signage, or practically any application for a screen which conveys information through light emission. Field emitters may also be used in non-display applications such as power supplies, printers, and X-ray sensors.

When used in a display, the electrons emitted by a field emitter are directed to an cathodoluminescent material. These display devices are commonly called Field Emitter Displays (FEDs). A field emitter used in a display may include a microelectronic emission surface, also referred to as a "tip" or "microtip". Conical, pyramidal, curved and linear pointed tips are often used. Alternatively, a flat tip of low work function material may be provided. An emitting electrode typically electrically contacts the tip. An extraction electrode or "gate" may be provided adjacent, but not touching, the field emission tip, to form an electron emission gap therebetween. Upon application of an appropriate voltage between the emitting electrode and the gate, quantum mechanical tunneling, or other known phenomena, cause the tip to emit electrons. In microelectronic applications, an array of field emission tips may be formed on the horizontal face of a substrate such as a silicon semiconductor substrate, glass plate, or ceramic plate. Emitting electrodes, gates and other electrodes may be provided on or in the substrate as necessary. Support circuitry may also be fabricated on or in the substrate.

The FEDs may be constructed using various techniques and materials, which are only now being perfected. Preferred FED's may be constructed of semiconductor materials, such as silicon. There are two predominant processes for making field emitters; "well first" processes, and "tip first" processes. In well first processes, such as a Spindt process, wells are first formed in and/or on a substrate, and tips are later formed in the wells. In tip first processes, the tips are formed first, and the wells are formed around the tips. There are multitudes of variations of both the well first and the tip first processes. The present invention relates primarily to well first processes of making FEDs and FEDs made by a well first process.

The electrical theory underlying the operation of an FED is similar to that for a conventional CRT. Electrons supplied by a cathode are emitted from the tips in the direction of a display surface, for example. The emitted electrons strike phosphors on the inside of the display which excites the phosphors and causes them to luminesce. An image is produced by the collection of luminescing phosphors on the inside of the display screen. This process is a very efficient way of generating a lighted image.

In a CRT, a single electron gun is provided to generate all of the electrons which impinge on the display screen. A complicated aiming device, usually comprising high power consuming electromagnets, is required in a CRT to direct the electron stream towards the desired screen pixels. The combination of the electron gun and aiming device behind the screen necessarily make a CRT display prohibitively bulky.

FEDs, on the other hand, may be relatively thin. Each pixel of an FED has its own electron source, typically an array or grouping of emitting microtips. The voltage difference between the cathode and the gate causes electrons to be emitted from the microtips which are in electrical proximity with the cathode. The FEDs may be thin because the microtips, which are the equivalent of an electron gun in a CRT, are extremely small. Further, an FED does not require an aiming device, because each pixel has its own electron gun (i.e. an array of emitters) positioned directly behind it. The emitters need only be capable of emitting electrons in a direction generally normal to the FED substrate.

The operation of an FED may be improved by spacing the emitter microtips in a relatively densely packed array. Close spacing of the emitter tips permits the use of more emitter tips per pixel, and a corresponding increase of electron flux per pixel and/or a reduction in the power required from each individual emitter tip. This results in a brighter display and a display that is less susceptible to be adversely affected by the failure of some of the emitter tips or low yield of emitter tip formation.

The operation of an FED may also be improved by reducing the distance between the emitter microtips and the gate which surrounds them. Electron emission may be improved by striving to make the gate opening surrounding the emitter microtip on the same order of magnitude as the radius of the emitter microtip "tip" itself. By reducing the distance between the gate and the emitter tip, the turn-on power requirements of the gates may be reduced, thereby making the FED more energy efficient and less susceptible to gate to tip leakage. In order to produce such gates with small openings, it is necessary to make wells with correspondingly small openings.

The desired tight spacing and small openings of wells may be very difficult, if not impossible, to achieve using many of the previously known methods of well formation. For example, one known method of forming wells consisted of depositing a layer of photoresistive material over the substrate in which the wells are to be formed. A mask is then placed over the photoresistive material, and selective portions of the photoresistive material are exposed to light through openings in. the mask. The mask is then removed, and the exposed (or unexposed) portions of the photoresistive material are then removed. The remaining photoresistive material may be used to mask the substrate for subsequent deposition and/or etching steps. The wells may be formed by etching into the substrate between the remaining photoresistive material or by depositing material on the substrate. After the wells are formed, the remaining photoresistive material is removed. Using the foregoing method, the spacing and opening size of wells is limited by the fineness of the mask placed over the photoresistive material. Furthermore, the finer the mask, the more delicate it is and the harder it is to work with.

As an alternative to the use of a physical mask, laser interferometry may be employed to impart a finely spaced pattern on photoresistive material. For example, Hanawa et al. U.S. Pat. No. 5,328,560 (Jul. 12, 1994) for a Method Of Manufacturing Semiconductor Device, discloses the use of an excimer laser to selectively irradiate a negative type resist layer for the production of a semiconductor device. By selective irradiation, a protonic acid is generated in the exposed portion of the resist layer. The resist is than baked and developed resulting in the non-exposed portion of the resist layer being dissolved. A resist pattern is left which may be used to form features in or on an underlying semiconductor substrate.

Hanawa et al. also disclose the undesireablity of the effects of multiple reflection in the photoresist film produced by interference between irradiated light and light reflected from the underlying semiconductor substrate. In order to prevent the effects of multiple reflections in film, an organic antireflective film is utilized. The antireflective film is not disclosed in Hanawa to be etched other than such that its dimension is the same as the resist pattern overlying the antireflective coating. Ito et al. U.S. Pat. No. 5,547,787 (Aug. 20, 1996) for Exposure Mask, Exposure Mask Substrate, Method For Fabricating The Same, And Method For Forming Pattern Based On Exposure Mask, discloses an arrangement similar to that of the Hanawa '560 patent.

In order to achieve densely packed well spacing, Applicants developed a laser interferometric lithographic system for exposing selective portions of a layer of photoresistive material on a substrate. Applicants' system is described in the copending U.S. patent application Ser. No. 08/721,460 filed Sep. 27, 1996, entitled Laser Interferometric Lithographic System Providing Automatic Change Of Fringe Spacing, which is incorporated herein by reference. Instead of applying a physical mask over the photoresistive material to shield portions of it, the photoresistive material is exposed to the light interference pattern of a laser, i.e. a fringe pattern. The interference pattern exposes only selective portions of the photoresistive material. By making the interference pattern very tightly spaced (i.e. of fine pitch), the pattern of exposed portions of photoresistive material can also be very tightly spaced. Very densely packed well arrays may be formed from the tightly spaced pattern of exposed photoresistive material.

In order to make densely packed well arrays with a high degree of precision it is necessary to carry out the laser interference lithography on a very smooth, low reflection surface. This is particularly true when precise far submicron patterning is desired. The present invention may increase the precision of forming FED well arrays using a method of laser interference lithography by reducing the amount of laser light that is reflected off the FED substrate and onto the backside of the photoresistive material.

Applicants have determined that it may be beneficial to the formation of wells on a substrate to form a laser lithographic mask structure having multiple layers in a stack which undercut or overhang one another. In particular it has been discovered that a desirable well formation may be made using a mask structure having a lower layer (i e. adjacent the substrate) which is undercut below an overhanging upper layer.

OBJECTS OF THE INVENTION

It is therefore an object of the present invention to provide methods and apparatus for making emitter wells and emitters in and on a substrate.

It is another object of the present invention to provide mask structures used to form emitter wells in and on a substrate.

It is a further object of the present invention to provide laser lithographic methods and apparatus for making mask structures on a substrate.

It is still another object of the present invention to provide methods and apparatus for controlling the size, shape, and pitch of the mask structures formed on a substrate.

It is yet another object of the present invention to provide a mask structure comprising photoresistive material and antireflective coating material.

It is still yet another object of the present invention to provide a mask structure with an undercut lower layer of material.

It is yet a further object of the present invention to provide methods and apparatus for monitoring and controlling the development of mask structures on a substrate.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical method of making a mask structure useful for the formation of wells in which field emitter tips may be formed, the method comprising the steps of: providing an antireflective coating on the upper surface of a field emitter substrate; providing a layer of photoresistive material overlying said antireflective coating; selectively exposing portions of said layer of photoresistive material to light, thereby forming exposed and unexposed portions of said layer of photoresistive material; removing said unexposed portions of the layer of photoresistive material; and removing selective portions of said antireflective coating so that a mask structure comprising photoresistive material and antireflective coating is formed.

Applicants have also developed an innovative and economical mask structure provided on a field emitter substrate, said mask structure being useful for the formation of wells on said field emitter substrate and comprising: plural antireflective islands provided on said substrate; and a photoresistive island overlying each antireflective island, wherein the pitch of said antireflective islands corresponds with the pitch of emitter tips which are to be formed on said substrate.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 1:
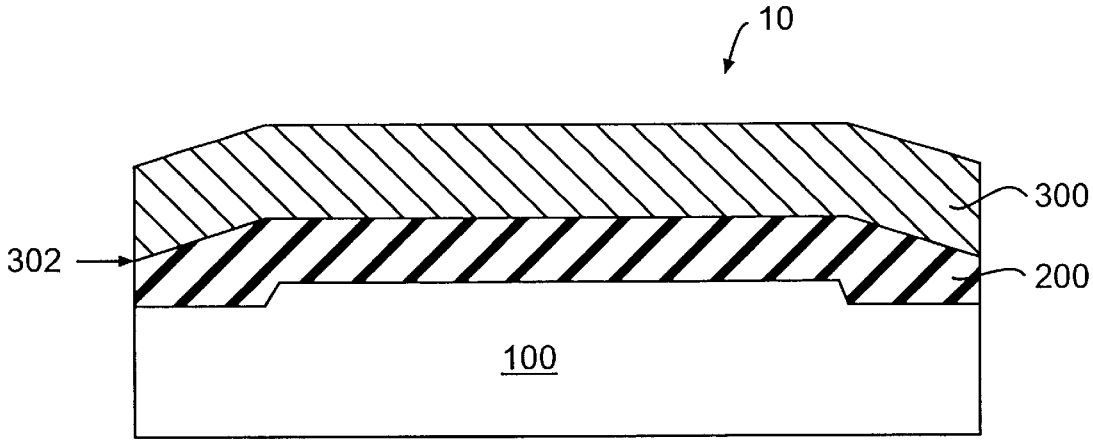
FIG. 1 is a cross-sectional view in elevation of a field emitter substrate including an antireflective coating and a photoresistive layer.

Reference will now be made in detail to a preferred embodiment of the present invention, an example of which is illustrated in the accompanying drawings. A preferred method embodiment of the present invention may be illustrated starting with the structure 10 shown in FIG. 1. Structure 10 may comprise a field emitter substrate 100, an antireflective coating 200, and a photoresistive layer 300. The field emitter substrate 100 may provide material in and on which emitter wells may be formed. The substrate 100 may comprise a layer of polysilicon, including an upper layer of silicon dioxide or other suitable insulator.

An antireflective coating 200 may be provided on an upper surface of the substrate 100. The antireflective coating preferably may have a thickness that is out of phase with the wavelength of the interfering laser light to which the antireflective coating may be exposed. For example, an antireflective film thickness of 0.3 microns is practical for a krypton laser with 413 nanometer wavelength. The antireflective coating 200 may also have a refractive index as close in number as possible to that of the photoresistive layer 300 overlying the antireflective coating. Example materials are commercial antireflective coating materials such as Brewer ARC™. Following application, the antireflective coating may be baked (e.g., 150 deg C., 75 min).

Following the baking of the antireflective coating 200, the photoresistive layer 300 may be applied to the upper surface of the coating 200. Positive resist is preferred to form raised dots of photoresistive material. Negative resist is preferred to form a layer of photoresistive material in a lattice pattern with holes therein extending down to the underlying antireflective coating 200. The use of positive or negative resist to form dots and holes, respectively, can be inverted by variations in exposure doses and methods of interference. The thickness of the antireflective coating 200 and the photoresistive layer 300 may be varied depending upon the patterns to be formed in the layer and coating, and depending upon the desired fineness of this pattern. An exemplary antireflective coating 200 may be on the order of 0.05–2 microns thick and the photoresistive layer 300 may be about 0.1–2 microns thick.

Figure 11:
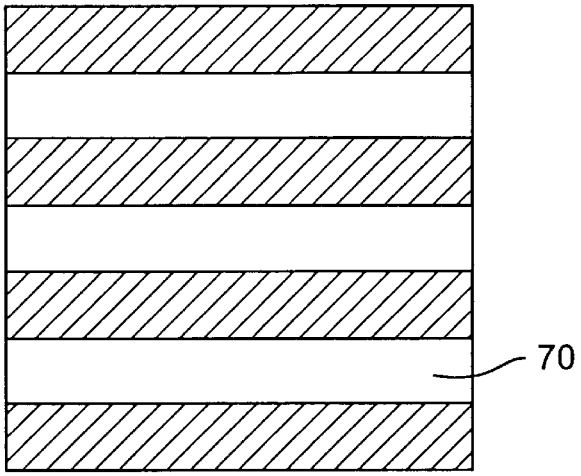
FIG. 11 is a plan view of a field emitter substrate illustrating the pattern of light exposure produced by a first exposure to the laser lithography process used in the invention.

The structure 10, and in particular the photoresistive layer 300, may then be exposed using the technique of laser interference lithography. In alternative embodiments the photoresistive layer 300 may be selectively exposed using any lithography exposure method. Following a first exposure, the structure 10 may have an exposure pattern such as shown in FIG. 11.

Figure 14:
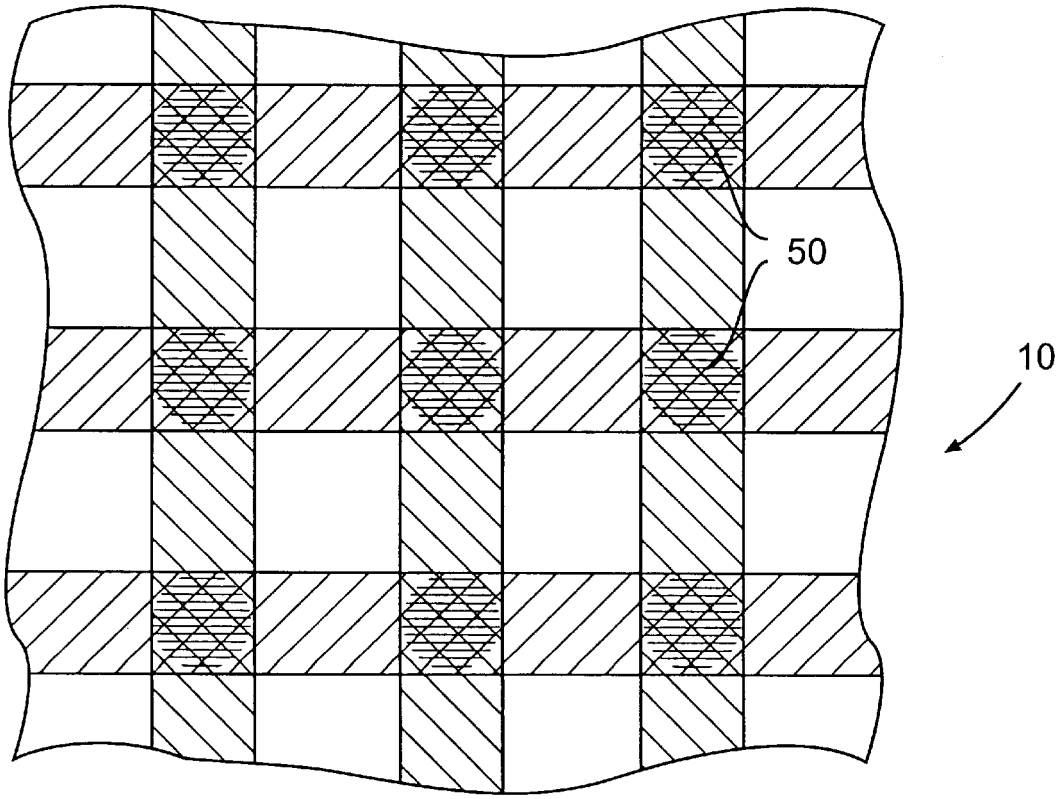
FIG. 14 is a plan view illustrating the pattern of light exposure produced by two exposures to the laser lithography process at right angles to each other.
Figure 12:
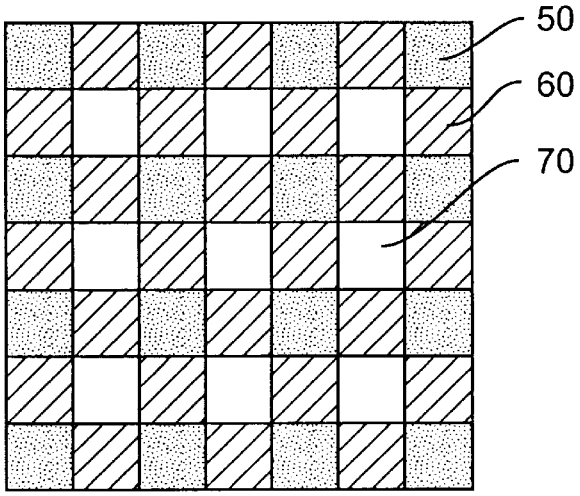
FIG. 12 is a plan view of a field emitter substrate illustrating the pattern of light exposure produced by a second exposure to the laser lithography process used in the invention.
Figure 13:
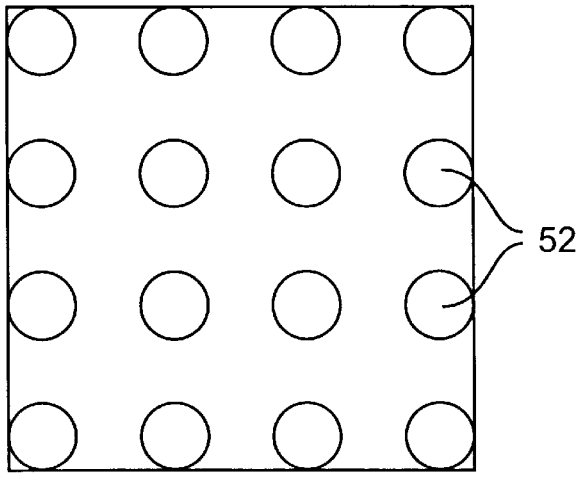
FIG. 13 is a plan view of a field emitter substrate illustrating the pattern of resist dots produced by the laser lithography process used in the invention.

The structure 10 may then be rotated 90 degrees and exposed again to the laser light. If the same exposure time is used in both exposures, a checkered pattern of twice exposed areas 70, single exposed areas 60, and non-exposed areas 50 is created, as shown in FIG. 12. After development, a pattern of dots 52 or a hole pattern will result, as shown in FIG. 13. If moderately different light doses for the two exposures are used, an oval pattern may result after development as shown in FIG. 14. In an alternative embodiment, the structure 10 may not be rotated after the first exposure to laser light, thereby resulting in a parallel line pattern of photoresistive material following development. The pitch or spacing between the dots, holes, or lines may be controlled by the positioning of mirrors included in the laser interferometer device. Dot, hole, or line size also may be controlled by variation of light exposure dose, development time, and/or developer concentration.

The presence of the antireflective coating 200 may reduce the amount of laser light that reflects back off the substrate 100 and onto the back side 302 of the photoresistive layer 300. By having a refractive index close to, or the same as, the refractive index of the photoresistive layer 300, the antireflective coating 200, may reduce standing waves of interfering light in the photoresistive layer. The reduction of these standing waves may in turn reduce the undesired exposure of the photoresistive layer 300 along the edges of the desired pattern.

Next, the photoresistive layer 300 may be developed by submersion in a dilute developer (e.g. a 0.2 normality TMAH developer solution (Shipley 702) for JSR IXL790™ (7 Cp) positive resist. The spacing between the dots, holes, or lines which form during development may be controlled using a feedback development process. For feedback development, a CCD camera, or other photosensitive monitoring device, may be used to monitor the change in the dot, hole, or line spacing during development. As development progresses the dots, lattice structure, or lines will shrink in size and the space therebetween will increase. A puddle of developer on the upper surface of the photoresistive layer 300 or slight submergence of the structure 10 in a bath of developer permits direct monitoring of the development process when a feedback development process is used. The development of the photoresistive layer 300 may be arrested when the desired spacing is reached. Arresting of the development process may be automated to be responsive to there being a predetermined distance between adjacent photoresistive islands (e.g. dots, lattice patterns, or lines).

Figure 2:
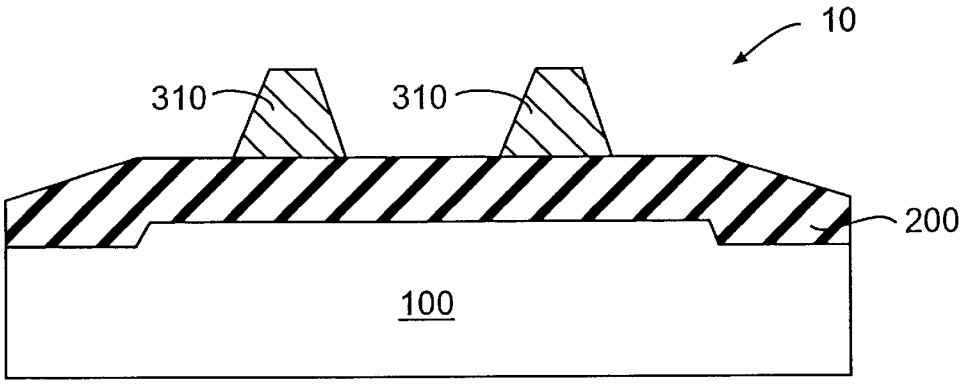
FIG. 2 is a cross-sectional view in elevation of the field emitter substrate of FIG. 1 following the development of the photoresistive layer.

The structure 10 may be rinsed with clean water or water containing a weak acid, such as citric acid, to arrest the development process. Then the structure 10 may be dried by spinning, alcohol vapor, or high velocity air. Following the rinsing and drying process, the structure 10 may have a cross-section resembling that of FIG. 2. With reference to FIG. 2, photoresistive islands 310 may be formed on the surface of the antireflective coating 200. The use of the antireflective coating 200 may result in precisely defined edges on the photoresistive islands 310 as well as precise location of the islands on the antireflective coating.

Figure 3:
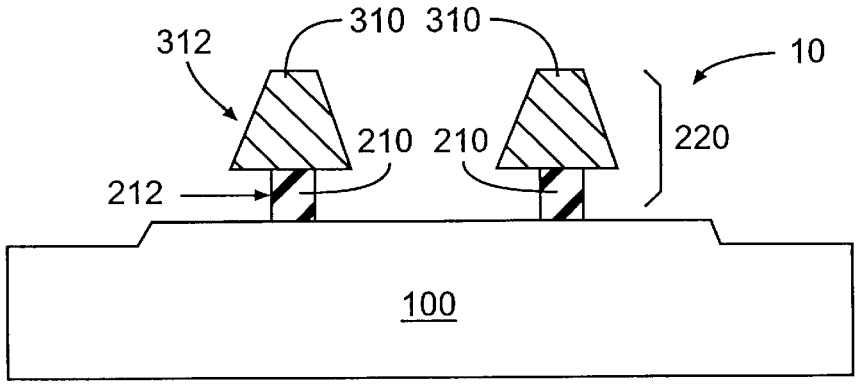
FIG. 3 is a cross-sectional view in elevation of the field emitter substrate of FIG. 2 following the formation of mask structures.

With reference to FIG. 3, reactive ion etching (RIE) may be used to transfer the pattern of the photoresistive islands 310 into the antireflective coating 200 to form antireflective islands 210. For example, a $CF_4$+oxygen RIE process may be used to etch the antireflective coating 200. The gas ratio, pressure, and power of the RIE process may be custom tailored to result in somewhat straight photoresistive island walls 312 and/or straight walls 212 of the antireflective islands 210.

The RIE process also may be tailored to form antireflective islands 210 which are alternatively undercut or flush with the overlying photoresistive islands 310. Treatment of the structure 10, and the antireflective islands 210 in particular, with an adhesion promoter, such as HMDS, or other silalating and hardening compounds can be used to enhance the undercut of the antireflective islands 210 under the photoresistive islands 310. The use of HMDS or other silalating and hardening compounds may also be used to sharpen or taper the walls 212 of the antireflective islands 210. This hardening may widen the process tolerances for producing acceptable undercut antireflective islands, but is not necessary for most applications.

Figure 4:
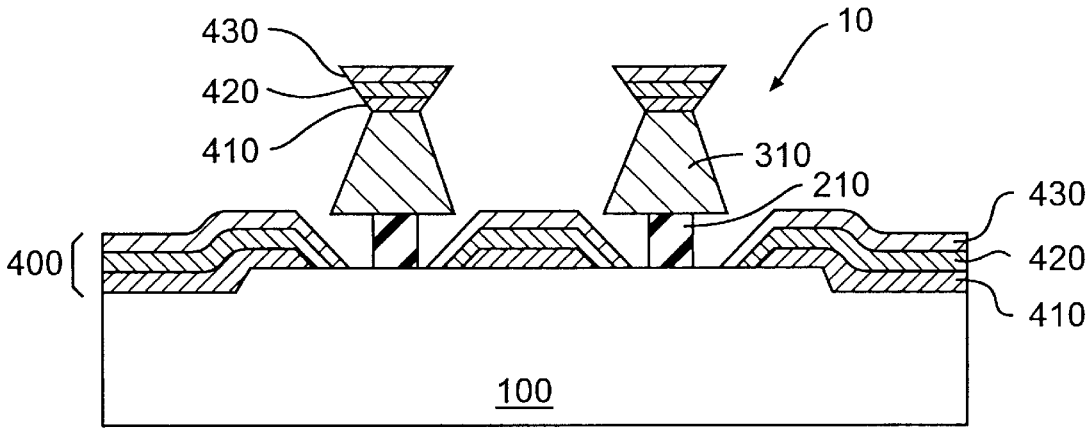
FIG. 4 is a cross-sectional view in elevation of the field emitter substrate of FIG. 3 following the application of gate conductor material.

The combined photoresistive islands 310 and antireflective islands 210 (also referred to as mask structure 220) may be used in a veil field emitter process or an etched gate process to form emitter wells. A veil type process for forming emitter wells is illustrated in FIG. 4. With positive resist structures (islands 210 and 310) directional deposition of gate conductor material 400 may be carried out such that holes are left in the layer of gate conductor material wherever the photoresistive islands 310 and antireflective islands 210 block the deposition of this material.

One or more layers of gate conductor material may be applied to the surface of the structure 10 to form an gate conductor 400. In an exemplary embodiment, successive layers of chromium 410, copper 420, and nickel 430 may be formed on the upper surface of structure 10 to form gate conductor 400. In alternative embodiments, the gate conductor 400 may comprise fewer, or more than, three distinct material layers.

By depositing the one or more layers of gate conductor material at increasing angles (by increasing the source size, increasing chamber pressure, or using off angle depositions for the latter depositions) a well may be formed as shown in FIG. 4, where each distinct layer of gate conductor material 410, 420, and 430 may extend down the sidewall of the gate conductor 400 to the substrate 100.

Figure 5:
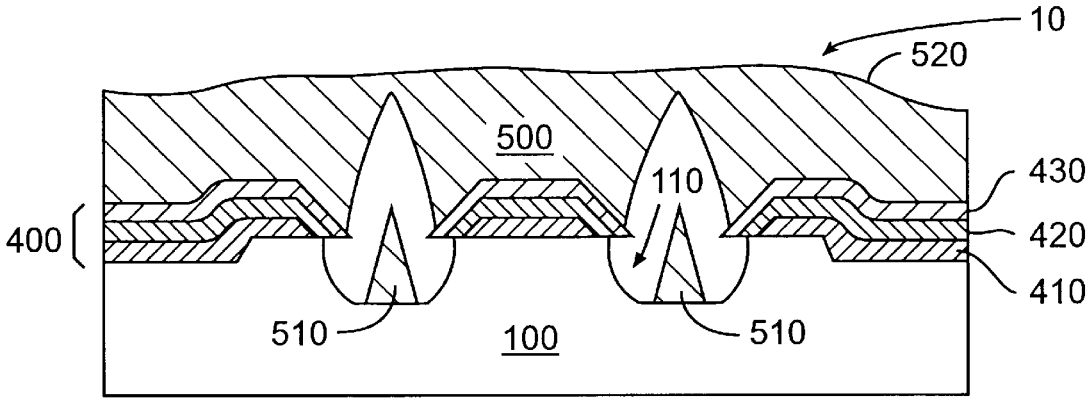
FIG. 5 is a cross-sectional view in elevation of the field emitter substrate of FIG. 4 following the application of emitter material.

Following formation of the gate conductor 400, the antireflective islands 210 and photoresistive islands 310 may be lifted off using a KOH solution or solvent. With reference to FIG. 5, the substrate 100 may be etched, subsequently, using RIE and BOE processes. The upper nickel layer 430 of the gate conductor 400 may act as an etch mask such that the exposed portions of the substrate 100 are etched down and under the gate conductor 400 thereby forming wells 110 in the substrate.

Figure 6:
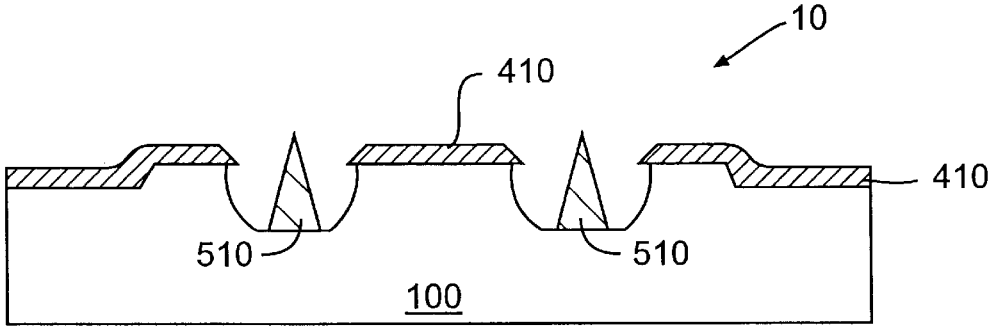
FIG. 6 is a cross-sectional view in elevation of the field emitter substrate of FIG. 5 following the removal of an upper layer of gate conductor material and emitter material.

Emitters 510 may be formed in the wells 110 by evaporating emitter material 500 onto the surface of the structure 10. By applying the emitter material 500 at an oblique angle, cone shaped emitters 500 may build up in the wells 110 as the holes in the gate conductors 400 are closed off by the build up of an upper layer of emitter material 520 on the upper surface of the nickel layer 430. Then etches that attack the nickel and/or copper gate conductor layers, 420 and 430, may be used to liftoff the upper layer of emitter material 520 without removing the chromium gate conductor layer 410, leaving the emitter structure shown in FIG. 6.

Figure 7:
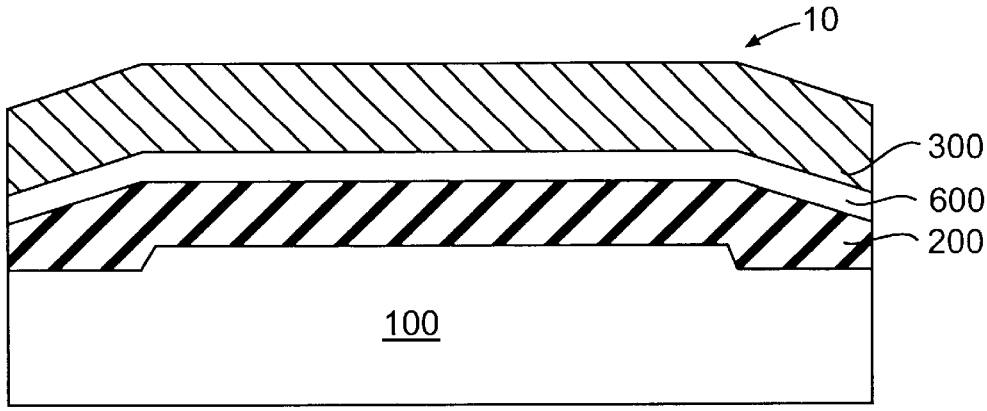
FIG. 7 is a cross-sectional view in elevation of a field emitter substrate including an antireflective coating, an etch resistant layer, and a photoresistive layer.

In alternative embodiments of the invention, one or more additional layers of material may be interposed between the antireflective coating and the photoresistive layer. With reference to FIG. 7, an etch resistant layer 600 may be provided between the antireflective coating 200 and the photoresistive layer 300. The etch resistant layer 600, for example, may comprise a 100 nanometer thick layer of evaporated silicon dioxide. The photoresistive layer 300 may be exposed to laser light and developed in accordance with the process set forth above in the discussion of FIGS. 1 and 2 to form photoresistive islands 310.

The etch resistant layer 600 may be any material that may be selectively etched relative to the antireflective coating 200. In other words, the etch resistant layer 600 should be etchable under different conditions than those used to etch the antireflective coating 200. For example, an etch resistant layer 600 of $SiO_2$ may be anisotropically etched with a $CF_4$ RIE. Afterwards, the antireflective coating 200 may be isotropically etched using an $O_2$ RIE to produce a structure with an undercut antireflective coating.

The etch resistant layer 600 may be preferrably formed with a selective thickness calculated with the formulae:

$$d=\text{lambda}/4n,$$

where d is the thickness of the etch resistant layer, lambda is the wavelength of the laser light used in the lithography process, and n is the refractive index of the etch resistant layer. By selectively adjusting the thickness of the etch resistant layer, the light reflected at the interface of the photoresistive layer 300 and the etch resistant layer 600 can be made to be 180 degrees out of phase with the light reflecting off the surface of the antireflective layer. This may reduce or eliminate standing waves of light exposure in the photoresistive layer 300.

Figure 8:
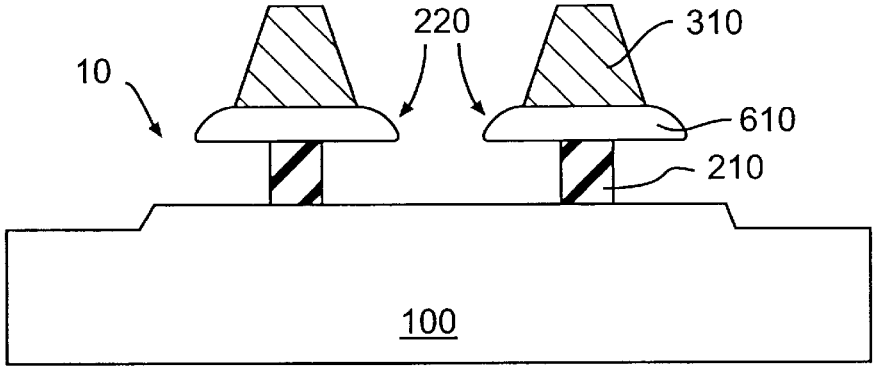
FIG. 8 is a cross-sectional view in elevation of the field emitter substrate of FIG. 7 following the development of the photoresistive layer and formation of mask structures.

With reference to FIG. 8, either RIE or wet chemical etching of the exposed etch resistant layer 600 and antireflective coating 200 may be used to achieve etch resistant islands 610 and antireflective islands 210. The pattern of the photoresistive islands 310 is thereby transferred to the etch resistant layer 600 and antireflective coating 200 by an etching process similar to that described with reference to FIGS. 1 and 2, above.

After the etch resistant layer 600 is etched to form etch resistant islands 610, the antireflective islands 210 may be undercut by additional etching in an isotropic oxygen plasma or wet etching in an alkaline solution. This additional etching may attack the antireflective islands 210 more rapidly than the etch resistant islands 610, so that a mask structure 220 is formed. The mask structure 220 in FIG. 8 comprises an overhanging stand, the mask structure does not necessarily need to include photoresistive islands and/or etch resistant islands that overhang lower layers or coatings of material. Following etching of the overhanging stands 220 with an isotropic oxygen plasma, the photoresistive islands 310 may be removed in part or whole. The amount of undercut of the aforementioned Brewer antireflective coating materials may be controlled by controlling developer concentration and bake temperature of the coating.

The structure 10 shown in FIG. 8 may also provide a more planar photoresistive layer 300. A more planar photoresistive layer may be achieved as a result of the use of a spin coated underlying antireflective coating. Spin coating of the antireflective coating results in the coating filling any gaps or irregularities in the surface of the substrate 100. For example, the substrate 100 may include metal lines which create an uneven surface on the substrate. Gaps between these metal lines may be filled with antireflective coating to provide a planar surface for the application of the photoresistive layer.

Following the formation of the overhanging stands 220, the formation of emitter wells and emitters may be carried out as described above with reference to FIGS. 4, 5, and 6. The overhanging stands 220 may be useful for evaporation and liftoff processing (i.e. a veil field emitter process or an etched gate process).

Figure 9:
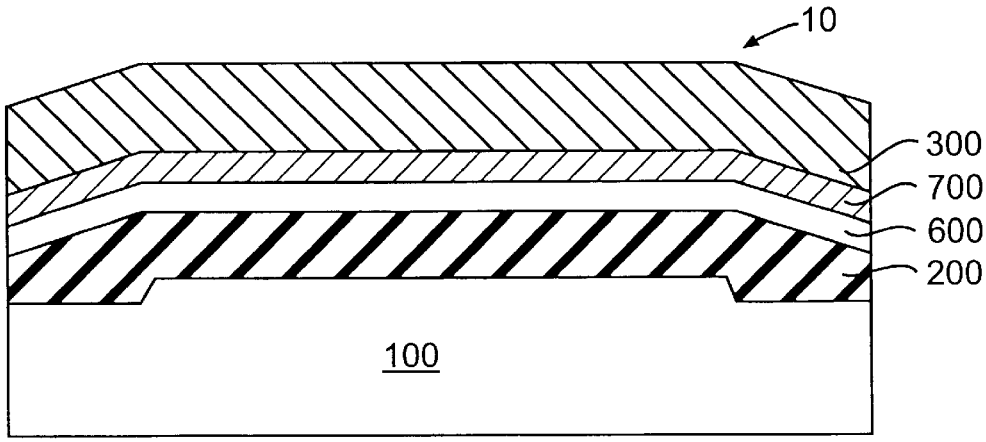
FIG. 9 is a cross-sectional view in elevation of a field emitter substrate including an antireflective coating, an etch resistant layer, a second antireflective coating, and a photoresistive layer.

With reference to FIG. 9, in an alternative embodiment of the invention, the structure 10 may be provided with a second antireflective coating 700 between the etch resistant layer 600 and the photoresistive layer 300. The second antireflective coating 700 may be used for additional smoothing and to further null standing waves in the photoresistive layer 300. Thus this second antireflective coating 700 may further reduce the exposure of the photoresistive layer 300 to laser light reflected off of the substrate 100 onto the underside of the photoresistive layer.

Figure 10:
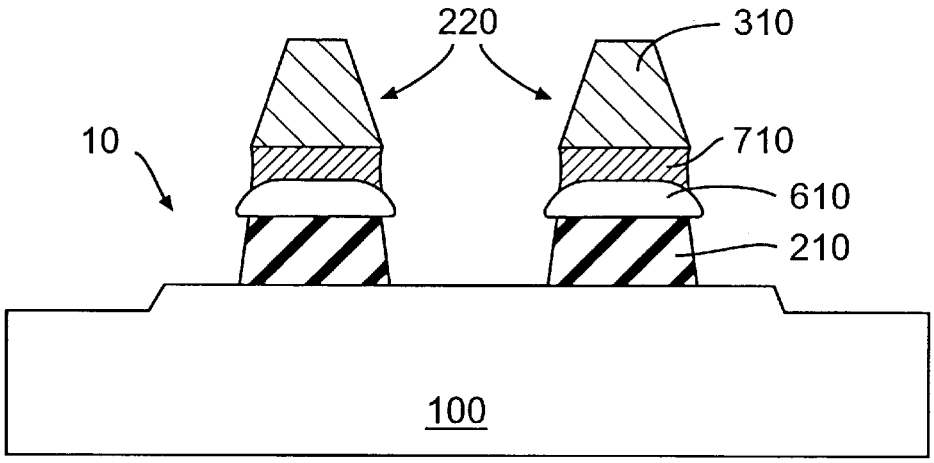
FIG. 10 is a cross-sectional view in elevation of the field emitter substrate of FIG. 9 following the development of the photoresistive layer and formation of mask structures.

With reference to FIG. 10, overhanging stands 220 may be formed in a process similar to that described above in reference to FIGS. 7 and 8. The overhanging stand 220 shown in FIG. 10 includes a second antireflective island 710 in the stack. Following the formation of the overhanging stands 220, the formation of emitter wells and emitters may be carried out as described above with reference to FIGS. 4, 5, and 6.

It will be apparent to those skilled in the art that various modifications and variations can be made in the construction, configuration, and/or operation of the present invention without departing from the scope or spirit of the invention. For example, in the embodiments mentioned above, various changes may be made to the processes used to form emitter wells and emitters following the formation of photoresistive, antireflective, and/or etch resistant islands on the underlying substrate. Variations in the shapes and sizes of the photoresistive, antireflective, and etch resistant islands, as well as variations in the undercut of the etch resistant and antireflective islands may be made without departing from the scope and spirit of the invention. Further, it may be appropriate to alter the type of system used to monitor the development of the photoresistive layer in a feedback development system without departing from the scope of the invention. Thus, it is intended that the present invention cover all the foregoing modifications and variations of the invention, as well as others which may be apparent to one of ordinary skill in the art, provided they come within the scope of the appended claims and their equivalents.

We claim:

1. In a process of making field emitter structures, a method of making a mask structure useful for the formation of wells in which field emitter tips may be formed, the method comprising the steps of:

providing an antireflective coating on the upper surface of a field emitter substrate;

providing a layer of photoresistive material overlying said antireflective coating;

selectively exposing portions of said layer of photoresistive material to laser light, thereby forming exposed and unexposed portions of said layer of photoresistive material;

removing one of said unexposed or exposed portions of the layer of photoresistive material; and removing selective portions of said antireflective coating so that a mask structure comprising photoresistive material and antireflective coating is formed.

2. The method of claim 1 wherein said step of selectively exposing comprises the step of laser interference lithography.

3. The method of claim 2 wherein said step of laser interference lithography comprises the steps of:

a) exposing the layer of photoresistive material to a multi-line pattern of laser light;

b) rotating said field emitter substrate ninety (90) degrees relative to said pattern of laser light; and c) repeating step (a).

4. The method of claim 3 wherein the times of laser light exposure are substantially the same for steps (a) and (c).

5. The method of claim 3 wherein the times of laser light exposure are different for steps (a) and (c).

6. The method of claim 1 further comprising the step of providing a layer of etch resistant material between said antireflective coating and said layer of photoresistive material.

7. The method of claim 6 wherein said etch resistant material comprises material selected from the group consisting of: SiO and $SiO_2$.

8. The method of claim 6 further comprising the step of providing a second antireflective coating between said layer of etch resistant material and said layer of photoresistive material.

9. The method of claim 6, wherein said etch resistant layer is selectively provided to have a thickness determined by the formulae d=lambda/4n, where d is the thickness of the etch resistant layer, lambda is the wavelength of the laser light used in the lithography process, and n is the refractive index of the etch resistant layer.

10. The method of claim 1 wherein the step of removing selective portions of antireflective coating comprises the step of etching said antireflective coating such that an antireflective island remains under each exposed portion of said layer of photoresistive material.

11. The method of claim 10 wherein a wall of said antireflective island is substantially perpendicular to said field emitter substrate.

12. The method of claim 10 wherein a wall of said antireflective island is undercut beneath said exposed portions of said layer of photoresistive material.

13. A method of making a mask structure on the surface of a field emitter substrate comprising the steps of:

providing an antireflective coating on the surface of the field emitter substrate;

providing a photoresistive layer on the antireflective coating;

exposing the photoresistive layer to a laser light interference pattern;

developing the photoresistive layer such that the photoresistive layer is removed from the antireflective coating with the exception of photoresistive islands; and etching the antireflective coating such that the antireflective coating is removed from the field emitter substrate with the exception of antireflective islands underlying and undercut beneath said photoresistive islands.

14. The method of claim 13 wherein said photoresistive islands comprise a structure selected from the group consisting of: a substantially circular dot, a substantially ovular dot, and a line.

15. The method of claim 13 wherein the step of developing the photoresistive layer comprises the steps of:

monitoring the development of the photoresistive layer to determine the distance between adjacent photoresistive islands; and arresting the development of the photoresistive layer responsive to there being a predetermined distance between adjacent photoresistive islands.

16. The method of claim 15 wherein the step of monitoring comprises the steps of:

measuring the distance between adjacent photoresistive islands;

comparing the measured distance with a predetermined distance; and providing an arresting signal responsive to the measured distance being substantially the same as the predetermined distance.

17. The method of claim 13 further comprising the step of applying a hardening compound to said antireflective coating after the step of etching.

18. A method of making a mask structure on the surface of a field emitter substrate comprising the steps of:

providing an antireflective coating on the surface of the field emitter substrate;

providing an etch resistant film on the antireflective coating;

providing a photoresistive layer on the etch resistant film;

exposing the photoresistive layer to a laser light interference pattern;

developing the photoresistive layer such that the photoresistive layer is removed from the etch resistant film with the exception of photoresistive islands; and etching the etch resistant film and antireflective coating such that the etch resistant film and the antireflective coating are removed from the field emitter substrate with the exception of etch resistant islands and antireflective islands underlying said photoresistive islands.

19. The method of claim 18 wherein said photoresistive islands comprise a structure selected from the group consisting of: a substantially circular dot, a substantially ovular dot, and a line.

20. The method of claim 18 wherein the step of developing the photoresistive layer comprises the steps of:

monitoring the development of the photoresistive layer to determine the distance between adjacent photoresistive islands; and arresting the development of the photoresistive layer responsive to there being a predetermined distance between adjacent photoresistive islands.

21. The method of claim 18 wherein said etch resistant film comprises material selected from the group consisting of: SiO and $SiO_2$.

22. The method of claim 18 wherein said etch resistant islands overhang associated underlying antireflective islands.

23. A method of making a mask structure on the surface of a field emitter substrate comprising the steps of:

providing an antireflective coating on the surface of the field emitter substrate;

providing an etch resistant film on the antireflective coating;

providing a second antireflective coating on the etch resistant film;

providing a photoresistive layer on the second antireflective coating;

exposing the photoresistive layer to a laser light interference pattern;

developing the photoresistive layer such that the photoresistive layer is removed from the second antireflective coating with the exception of photoresistive islands; and etching the second antireflective coating, the etch resistant film, and the antireflective coating such that the second antireflective coating, the etch resistant film, and the antireflective coating are removed from the field emitter substrate with the exception of second antireflective islands, etch resistant islands, and antireflective islands underlying said photoresistive islands.

24. The method of claim 23 wherein said photoresistive islands comprise a structure selected from the group consisting of: a substantially circular dot, a substantially ovular dot, and a line.

25. The method of claim 23 wherein the step of developing the photoresistive layer comprises the steps of:

monitoring the development of the photoresistive layer to determine the distance between adjacent photoresistive islands; and arresting the development of the photoresistive layer responsive to there being a predetermined distance between adjacent photoresistive islands.

26. The method of claim 23 wherein said etch resistant islands overhang associated underlying antireflective islands.

27. A mask structure provided on a field emitter substrate, said mask structure being useful for the formation of wells on said field emitter substrate and comprising:

plural antireflective islands provided on said substrate; and a photoresistive island overlying each antireflective island, wherein the pitch of said antireflective islands corresponds with the pitch of emitter tips which are to be formed on said substrate.

28. The mask structure of claim 27 wherein each antireflective island is undercut beneath each overlying photoresistive island.

29. The mask structure of claim 27 further comprising an etch resistant island between each antireflective island and photoresistive island.

30. The mask structure of claim 29 wherein each antireflective island is undercut beneath each associated etch resistant island.

31. The mask structure of claim 29 further comprising a second antireflective island between each etch resistant island and photoresistive island.

32. The mask structure of claim 31 wherein each antireflective island is undercut beneath each associated etch resistant island.

33. A mask structure provided on a field emitter substrate, said mask structure being useful for the formation of wells on said field emitter substrate and comprising:

an antireflective structure provided on said substrate;

an etch resistant structure provided on said antireflective structure and including an overhanging portion over said antireflective structure; and a photoresistive structure provided on said etch resistant structure;

wherein said etch resistant structure provides an overhanging mask adapted to permit selective gate material to be deposited under the overhanging portion of said etch resistant structure.

34. A mask structure provided on a field emitter substrate, said mask structure being useful for the formation of wells on said field emitter substrate and comprising:

an antireflective structure provided on said substrate;

an etch resistant structure provided on said antireflective structure and including an overhanging portion over said antireflective structure;

a second antireflective structure provided on said etch resistant structure; and a photoresistive structure provided on said second antireflective structure;

wherein said etch resistant structure provides an overhanging mask adapted to permit selective gate material to be deposited under the overhanging portion of said etch resistant structure.

35. The method of claim 1 wherein a wall of said exposed portions of said layer of photoresistive material is oblique to said field emitter substrate.

* * * * *